United States Patent [19]

Ballenger

[11] 3,956,842

[45] May 18, 1976

[54] GUN TRIGGER LOCK

[75] Inventor: Robert J. Ballenger, Highland Park, Ill.

[73] Assignee: Central Specialties Co., Chicago, Ill.

[22] Filed: July 26, 1974

[21] Appl. No.: 485,893

[52] U.S. Cl. ..... 42/1 Y
[51] Int. Cl.[2] ..... F41C 27/10
[58] Field of Search ..... 42/1 Y

[56] References Cited

UNITED STATES PATENTS

| | | | |
|---|---|---|---|
| 2,882,636 | 4/1959 | Shinaver | 42/1 Y |
| 3,066,433 | 12/1962 | Rogers et al. | 42/1 Y |
| 3,139,694 | 7/1964 | Schaefer | 42/1 Y |
| 3,392,471 | 7/1968 | Foote | 42/1 Y |
| 3,422,560 | 1/1969 | Foote et al. | 42/1 Y |
| 3,616,559 | 11/1971 | Sobolewski | 42/1 Y |

*Primary Examiner*—Charles T. Jordan
*Attorney, Agent, or Firm*—Dominik, Knechtel, Godula & Demeur

[57] ABSTRACT

A gun trigger lock having a pair of opposed plates, the upper edges of which are recessed to accomodate a gun safety button irresepctive of whether in the forward portion or the rearward portion with relation to the trigger guard is disclosed in which a single pivotal connection is positioned at a remote rearward portion adjoining the two plates. In spaced relationship to the pivotal connection is a clamping member, shown as a threaded bolt, and the distance from the edge of the threaded bolt to the pivotal member is controlled by a spacer on the pivotal member to the end that the space approximates one-fourth of an inch. A cushion lining is provided on the interior portions of the two plates so that when the bolt is employed to clamp them together scratching is avoided, and a firm seated connection with the trigger guard is accomplished.

7 Claims, 13 Drawing Figures

FIG. 1
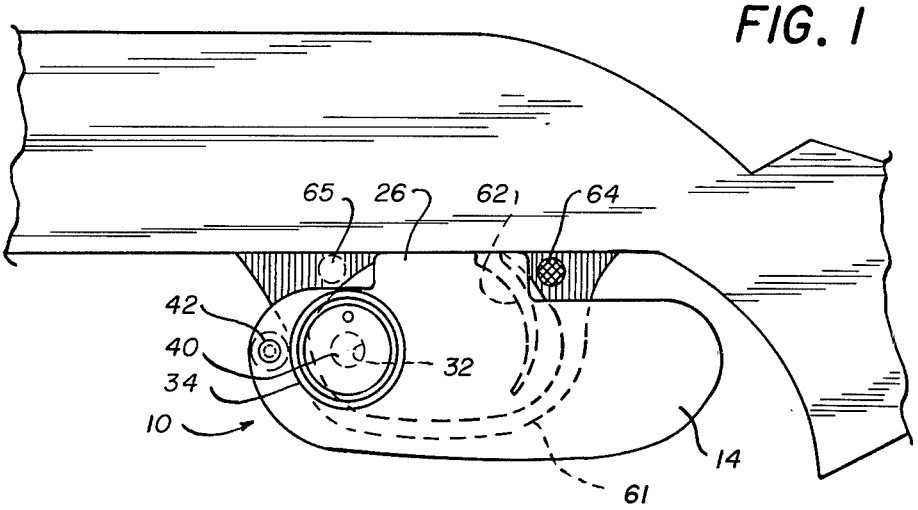
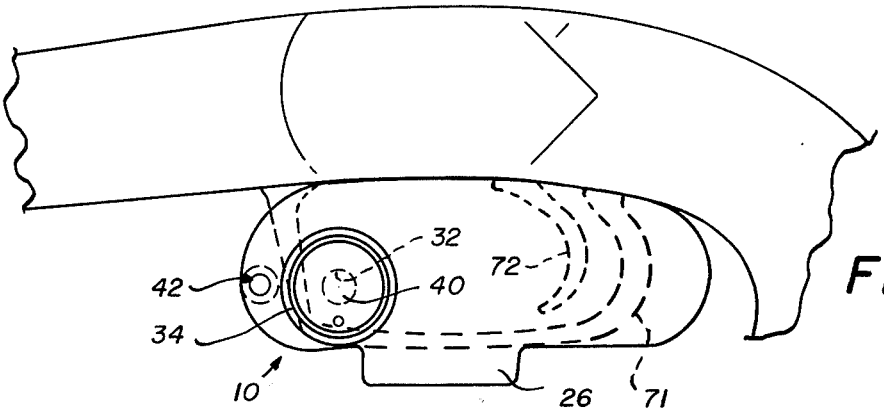
FIG. 2
FIG. 3
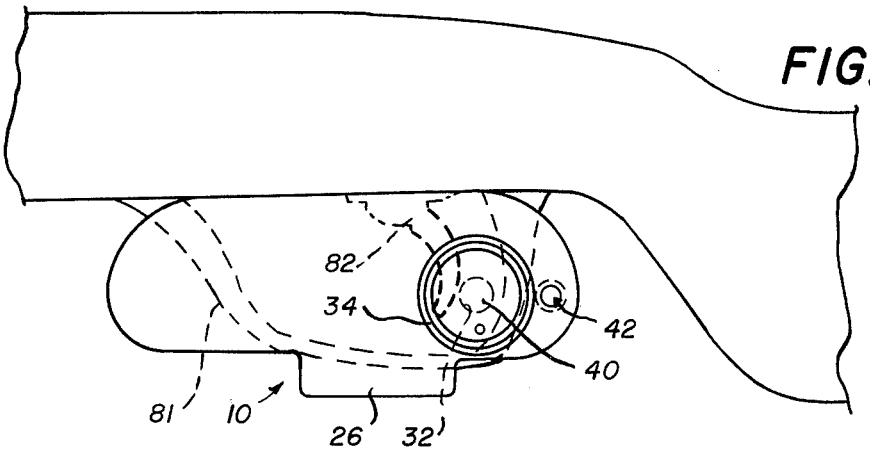

GUN TRIGGER LOCK

BACKGROUND OF THE INVENTION

1. Field of the Invention

The present invention relates principally to safety devices, and more particularly that type of device which is employed in conjunction with the trigger guard and triggers of a firearm, whether rifle or pistol, for the purpose of shielding the trigger from accidental discharge.

2. Description of the Prior Art

Previous devices of this type are illustrated in U.S. Pat. No. 3,139,694, assigned to applicant's assignee, and more recently issued U.S. Pat. No. 3,392,471. The bulk of the prior art gun trigger safety devices include a pair of opposed plates, and means for clamping the same to the trigger guard of the gun. Characteristic of most of these devices is compactness, the same calculated to approximate the configuration of a trigger guard. Also characteristic of the prior art devices is a clamping type member approximately central of the two plates. As a result of this positioning of the clamping member, even if adequate instructions are given by the manufacturer, a careless user may possibly improperly secure the safety device by reversing it in position on the trigger guard.

In addition, the exemplary prior art devices are formed in many instances with compound configurations which inherently increase the tooling cost without necessarily producing functional advantages.

SUMMARY

The present invention contemplates a gun safety device comprising a pair of opposed plates which are secured in flanking relationship to a trigger guard of the gun. The plates are elongate members, with identical configurations; desirably having a cut-out portion at the upper edge extending forwardly as well as rearwardly from a central upstanding member to accommodate the safety of the host gun irrespective of whether the same is located in the forward or rearward portion above the trigger guard. A pivotal securing member is positioned tying the two plates together at a forward position adjacent to the front edge of the two plates. Immediately rearward of this position, means are provided for clamping the two plates together, illustrated as a threaded bolt but other fastening means are contemplated. In order to prevent the positioning of the safety device with either the clamping means or the pivotal member in contact with the trigger, the pivotal member has a central spacer portion or an enlarged portion to provide a span distance between the spacer and the clamping means of approximately ¼ inch. This distance, subject to empirical modification, is the distance minimum for the wide majority of guns between the front portion of the trigger and the rearward portion of the rear end of the trigger guard. With the configuration described, the guard can be mounted in any of four positions, with the trigger guard of the gun masked by the two plates, and the securing means or bolt out of contact with the trigger. At all times the plates cannot extend any further across the area defined by the trigger guard than is permitted by the spacing achieved between the pivotal member and the clamping means once secured in position. Desirably the interior portion of the plates are provided with a cushion surface for seating firmly in scratch-resistant relationship with the exterior sides of the trigger guard.

In view of the foregoing, it is a principal object of the present invention to provide a gun safety trigger lock which is inherently reisisant to improper installation by the careless use, and still will obscure the trigger from finger contact, and maintain the interior portion of the trigger guard free of the trigger.

Another object of the present invention is to provide a gun safety trigger lock which will accommodate the gun safety in varying positions with regard to the trigger guard.

Still another important object of the present invention is to provide a gun trigger lock which is inherently inexpensive to manufacture, thereby rendering the cost to the user modest, as compared to the safety features afforded.

DESCRIPTION OF DRAWINGS

Further objects and advantages of the present invention will become apparent as the following description of an illustrative embodiment proceeds, taken in conjunction with the accompanying drawings in which:

FIG. 1 is a side elevational view showing the subject gun trigger lock mounted in one of its positions overlying the trigger guard;

FIG. 2 is a side elevational view of the subject gun trigger lock showing an inverted mounting posture thereof on a different gun style;

FIG. 3 is a side elevational view showing still another mounting for the subject gun trigger lock on still another variety of gun;

The details of the structure of the subject gun trigger lock are more particularly shown in FIGS. 4 through 13 of the drawings, and reference will be made to these figures in connection with the description of the gun trigger lock.

Figure 8:
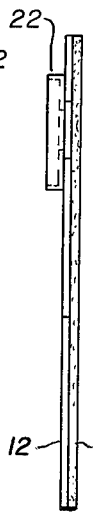
FIG. 8 is an end elevational view of the plate member of FIG. 7 showing a mounting collar positioned on the exterior surface thereof.
Figure 9:
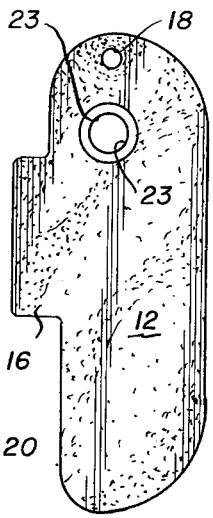
FIG. 9 is a side elevational view showing the interior portion of the plate member as illustrated in FIGS. 7 and 8.
Figure 13:
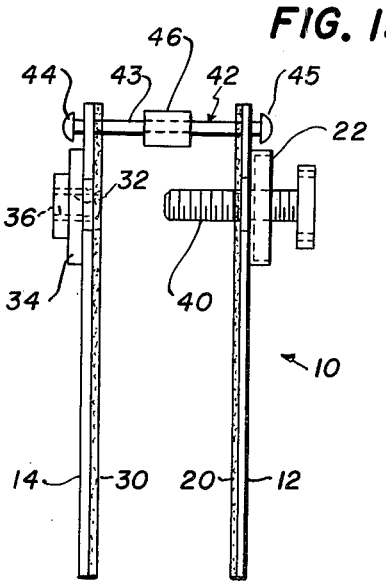
FIG. 13 is an end elevational view showing the assembly of the opposed plates pivotally connected with the clamping means positioned thereon.

The completed gun trigger lock 10 is shown in FIG. 13 of the drawings, as assembled. The gun trigger lock 10 includes a mounting plate 12 and receiving plate 14. The mounting plate 12 is more particularly shown in FIGS. 7 through 9 of the drawings and is shown to be generally oblong in configuration and including a block portion 16 extending outwardly from one side edge thereof thereby to give the side edge a recessed appearance. Along one end portion of the mounting plate 12 is a pin receiving aperture 18 in the manner illustrated in FIG. 13 of the drawings. In the preferred embodiment of the invention, the interior surface of the mounting plate 12 is provided with a rubberized or foam coating 20 which functions to prevent the gun trigger lock 10 from scratching the trigger guard as generally illustrated in FIGS. 1 through 3 of the drawings. The exterior surface of the mounting plate 12 is shown to include a mounting collar 22 which generally surrounds a bolt aperture 23. As shown in FIG. 8 of the drawings, the mounting collar 22 extends outwardly from the exterior surface of the mounting plate 12 and is of a sufficiently large diameter such as to accommodate the head of the threaded bolt which is received through the bolt aperture 23, again as shown in FIG. 13 of the drawings.

Figure 4:
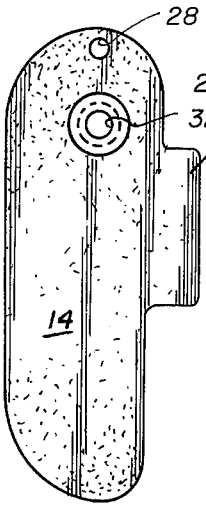
FIG. 4 is a side elevational view of the interior portion of one of the plate members.
Figure 5:
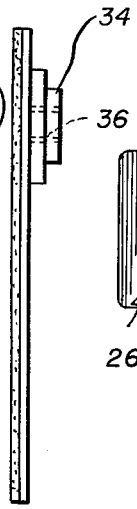
FIG. 5 is an end elevational view showing the plate member of FIG. 4 including a threaded collar arrangement mounted on the outer surface.
Figure 6:
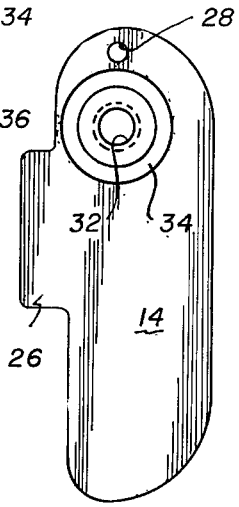
FIG. 6 is a side elevational view showing the exterior surface of the plate member as shown in FIGS. 4 and 5 of the drawings and of the collar arrangement thereon.
Figure 7:
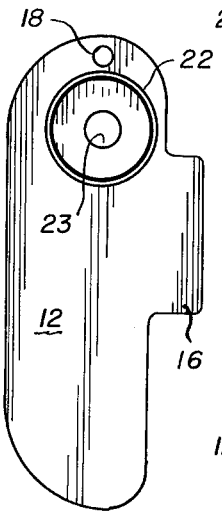
FIG. 7 is a side elevational view of the exterior surface of the opposed plate member.

Viewing FIGS. 4 through 6 of the drawings, the receiving plate 14 is illustrated therein. The receiving plate 14 similarly has an elongated oblong configuration with one edge thereof including a block portion 26 extending outwardly from the edge thereby to give the edge the appearance of a recessed configuration other than the block portion 26. Adjacent to the one edge of the receiving plate 14 is similarly positioned a pin receiving aperture 28 which functions to receive the opposing end of the pin member as shown in FIG. 13 of the drawings. As was discussed in connection with the mounting plate 12, the interior surface of the receiving plate 14 is provided with a rubberized or foam coating 30 to, once again, prevent possible scratching of the trigger guard associated with the gun when the trigger lock 10 is mounted thereon.

The receiving plate 14 further includes a bolt receiving aperture 32 which extends through the plate. On the exterior surface of the receiving plate 14 is a receiving collar 34 provided with a center bore 36 which is threaded. The bolt receiving aperture 32 of the receiving plate 14 is coextensive with the threaded center bore 36 of the receiving collar 34 and is designed to receive a threaded bolt 40 in screw threaded arrangement as illustrated in FIG. 13 of the drawings.

Figure 10:
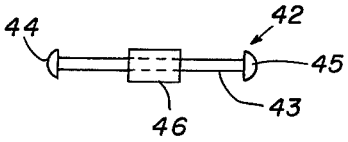
FIG. 10 is a view of the pin member and spacer positioned thereon utilized to pivotally mount the opposed plates.

FIG. 10 of the drawings illustrates the pin member 42 which is utilized in connection with the present invention. The pin member generally includes a shaft 43 bounded at each of the opposed ends by pin heads 44 and 45 respectively. The means for forming one of the two pin heads 44 and 45 is obviously dependent upon the manufacturing process utilized since it is necessary to first mount the mounting plate 12 and receiving plate 14 onto the shaft 43 by inserting the shaft 43 through the pin receiving apertures 18 and 28 respectively. Once the two plates 12 and 14 respectively are mounted on the shaft 43 of the pin member 42, the opposing pin head 45 may then be formed in any suitable process. In this manner, the two plate members 12 and 14 respectively are permanently pivotally secured along the length of the shaft 43 of the pin member 42.

As further shown in FIG. 10 of the drawings, the pin shaft 43 includes a spacer member 46 slidably mounted thereon and functions to not only retain the two plate members 12 and 14 in spaced relationship, but also regulates the distance between the pin member 42 and the threaded bolt 40.

Figure 11:
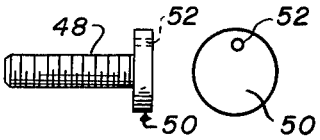
FIG. 11 is an elevational view showing the threaded bolt which coacts with the mounting collar and opposed collar to provide a clamp for the subject gun trigger lock.
Figure 12:
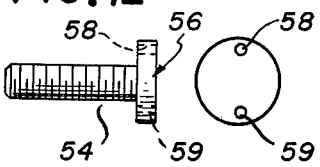
FIG. 12 is an elevational view showing another embodiment of a threaded bolt for use with the subject invention.

In FIGS. 11 and 12 of the drawings, two forms of a suitable threaded bolt are illustrated. In FIG. 11, the threaded bolt is shown to include a threaded member 48 and a bolt head 50. The bolt head is provided with an aperture 52 which coacts with a special wrench utilized to screw threadedly mount and demount the bolt from the respective plate members 12 and 14. The embodiment illustrated in FIG. 12 of the drawings similarly includes the threaded member 54 capped by bolt head 56 having a pair of apertures 58 and 59 positioned adjacent opposed ends of the bolt head 56. Once again, the provision of apertures 52 and 58 and 59 respectively have relevance only so far as a specialized wrench is utilized to screw and unscrew the bolt from the gun trigger lock 10. Hence, the provision of a specialized bolt having a bolt head with apertures provided therein is a further safety feature of the invention in that an ordinary screwdriver cannot be utilized to screw and unscrew the bolt. Hence, the risk of children or other unauthorized persons from being permitted to unscrew the bolt and open the gun trigger lock 10 is greatly minimized.

Insofar as the mounting of the gun trigger lock 10 onto a trigger guard is concerned, FIGS. 1 through 3 of the drawings is illustrative of the various mountings of the subject gun trigger lock 10 on a variety of guns. With reference to FIG. 1 of the drawings, the particular gun style illustrated is shown to include a trigger guard 61 surrounding a trigger 62. This particular gun style includes a gun safety 64, mounted rearward of the trigger 62, although in some models the gun safety can be located forward of the trigger 62 as represented by numeral 65, and it will be appreciated that the block portion 26 of the receiving plate 14 spaces the gun trigger lock 10 downwardly to permit the safety 64 or 65 sufficient room to be actuated. As shown in FIG. 1, the mounting plate 12 and receiving plate 14 overlie the trigger guard 61 of the gun thereby to conceal and guard the trigger 62 on either of the opposed sides of the trigger guard 61. In this mounting posture, the pin member 42 pivotally mounting the plates 12 and 14 together is positioned exteriorly of the trigger guard 61 while the threaded bolt 40 which cooperates with the bolt aperture 23 in the mounting plate 12 and the threaded center bore 36 formed in the receiving collar 34 of the receiving plate 14 is positioned interiorly of the trigger guard 61. Once so mounted, the operator merely operates the wrench (not shown) to screw threadedly secure the threaded bolt 40 into the threaded center bore 36 of the receiving plate 14 thereby to tighten the two plates 12 and 14 with respect to each other and on either side of the trigger guard 61. Hence, the only manner in which the gun trigger lock 10 can be removed is by utilizing the special wrench to unscrew the threaded bolt 40 such that the threaded bolt 40 is retracted from the threaded center bore 36 in order to permit the two plates 12 and 14 respectively to be pivotally moved with respect to each other.

In FIG. 2 of the drawings, another gun style is illustrated wherein the gun safety is located other than in connection with the gun trigger guard. This gun style includes a trigger guard 71 surrounding a trigger 72. The gun trigger lock 10 is shown to be mounted on the trigger guard 71 with the pin member 42 positioned exteriorly of the trigger guard 71 and the threaded bolt 40 is positioned interiorly of the trigger guard 71. On this particular gun style, it will be noted that the gun trigger lock 10 is mounted with the respective block portions 16 and 26 in the downward position since the gun style does not permit sufficient space adjacent the gun handle for the mounting as shown in FIG. 1 of the drawings. It is further apparent that in view of the positioning of the trigger 72 as well as the trigger 62 in FIG. 1 of the drawings, that the subject trigger gun lock 10 cannot be mounted with the threaded bolt 40 positioned at the rear end thereof between the rear surface of the trigger and the inner rear surface of the trigger guard. In other words, the spacing is such that the gun trigger lock 10 cannot be reversed and thereby afford the operator the potential of improper installation on that type of gun style.

In FIG. 3 of the drawings, still another gun type is illustrated wherein the gun is provided with a trigger guard 81 surrounding a trigger 82, the trigger 82 being spaced forwardly from the rear portion of the trigger guard 81. In order to mount the gun trigger lock 10, it will be observed that in this installation, the threaded bolt 40 is mounted interiorly of the trigger guard 81 and positioned between the rear surface of the trigger 82 and the interior surface of the trigger guard 81. The block portions 16 and 26 are positioned downwardly since, once again, the subject gun style does not have sufficient room adjacent the gun stock to permit the reverse mounting of the gun trigger lock 10. It will further be apparent that even should the gun trigger lock 10 be reversed in the mounting with respect to the gun shown in FIG. 3 of the drawings such that the pin member 42 is positioned exteriorly of the trigger guard 81 and at the forward end thereof and with the threaded bolt 40 positioned interiorly of the trigger guard 81, in the manner shown in FIG. 2 of the drawings, the elongate configuration of the plates 12 and 14 will still overlay the gun trigger guard 81 to prevent unauthorized tampering with the trigger 82.

Hence, it will be apparent that for virtually most of the guns presently available, and regardless of whether the trigger is spaced forwardly from the rear portion of the trigger guard associated with the gun, the subject gun trigger lock 10 may be mounted either forwardly or reversely, having reference to FIGS. 1 and 3 of the drawings, and still accomplish the intended safety features thereof.

It will be appreciated from the above description that there has been provided, by virtue of the present invention, an improved gun trigger lock which functions to shield access to a gun trigger once properly mounted in overlying relationship with respect to the gun trigger guard. Furthermore, the subject gun trigger lock is designed to permit installation in overlying relationship with respect to the gun trigger and gun trigger guard in either a forwardly or reversely pointed direction without sacrificing the safety features thereof.

It will further be appreciated that the subject gun trigger lock includes a minimum number of elements such that the overall manufacturing cost incident to the mass production of the item is greatly minimized. This is similarly considered to be an important feature of the invention since the obvious intent is to produce a gun trigger lock which can be geared for the mass market and priced sufficiently low so that even the modest purchasers are enabled to purchase the same. Hence, by affording the mass market the luxury of a safety gun trigger lock; the intended safety function is more likely to reach the bulk of the market.

It will be appreciated that all of the above objects and advantages, as well as additional objects and advantages have been provided by virtue of the present invention. While there has been described what is at present considered to be the preferred embodiments of the invention, it will be understood that various modifications may be made therein and it is intended to cover in the appended claims all such modifications as followed in the true spirit and scope of the invention.

What is claimed is:

1. A gun trigger lock for use in conjunction with a gun trigger guard comprising, in combination, a pair of opposed plates of elongate configuration, each of said plates provided with pin apertures adjacent one end of said plates, each of said plates including a block portion upstanding therefrom along one edge of each of said plates to accommodate a safety in the area above the trigger guard to accommodate the forward and rearward position of said gun trigger lock with regard to a trigger, a pin member received through said pin apertures in said plate and securing said plates together in mutual pivotal relationship, locking means proportioned to penetrate the space between the two plates and to draw said plates together when actuated in the locking posture, and spacer means provided on said pin member to define the space between said pin member and said locking means the space being a distance such as to accommodate the thickest portion of the trigger guard at its rear and forward portions on a gun to be safetied, whereby reversal of the gun trigger lock around the gun trigger guard results in the locking means being positioned out of contact with the forward portion of the trigger and prevents accidental firing of the gun.

2. The gun trigger lock as set forth in claim 1, wherein each of said plates is provided with a cushion lining on the interior portion thereof, whereby said plates, when locked together by the said locking means, are in cushioned relationship with respect to the trigger guard thereby to prevent undesired scratching of the triger guard and associated parts.

3. The gun trigger lock as set forth in claim 1, wherein the elongate length of the opposed plates is sufficient to thereby completely overlay the trigger guard associated with the gun.

4. The gun trigger lock as set forth in claim 1, wherein each of said plates includes a bolt aperture spaced a short distance from said pin apertures and one of said plates is provided with a threaded collar fixedly secured in surrounding relationship with respect to the associated bolt aperture, and a threaded bolt is provided in receiving relationship with respect to the bolt aperture of one of said plates and is screw threadedly received in said threaded collar of the opposed plate thereby permitting a screw type clamping action to lockingly engage the said opposed plates in overlying relationship with respect to the trigger guard.

5. The gun trigger lock as set for in claim 4, wherein said threaded bolt is further provided with a flat circular head, said flat circular head including at least one aperture disposed therein to accommodate the use of a prong wrench for screw threadedly fastening and unfastening said threaded bolt from screw threaded relationship with respect to the threaded collar of the opposed plate.

6. The gun trigger lock as set forth in claim 1, wherein said spacer means positioned on said pin member is of a thickness whereby the distance between said spacer means and said locking means when inserted between said opposed plates approximates one-fourth of an inch.

7. The gun trigger lock as set forth in claim 1, wherein one of said elongate plates is provided with a mounting collar and the opposed one of said plates is provided with a receiving collar, each of said mounting collar and receiving collar mounted on the exterior surfaces of said plates when in use, whereby said locking means utlized to draw the said plates together is surrounded by said mounting collar and said receiving collar thereby to prevent any unauthorized tampering with said gun trigger lock.

* * * * *